US005883861A

United States Patent [19]

Moser et al.

[11] Patent Number: 5,883,861

[45] Date of Patent: Mar. 16, 1999

[54] TIMEPIECE ASSOCIATED WITH A COMPASS AND A SIGHTING DEVICE

[75] Inventors: Nicolas Moser, Neuchâtel; Christophe Germiquet, Tuescherz, both of Switzerland

[73] Assignee: Asulab S.A., Bienne, Switzerland

[21] Appl. No.: 76,097

[22] Filed: May 12, 1998

(Under 37 CFR 1.47)

[30] Foreign Application Priority Data

May 14, 1997 [CH] Switzerland ..... 1130/97

[51] Int. Cl.[6] ..... G04B 47/00

[52] U.S. Cl. ..... 368/10; 33/263; 33/334

[58] Field of Search ..... 368/10; 33/263, 33/333, 334

[56] References Cited

U.S. PATENT DOCUMENTS

| | | | |
|---|---|---|---|
| 4,267,849 | 5/1981 | Smith | 131/84 R |
| 4,330,878 | 5/1982 | Nakamura | 368/250 |
| 4,373,624 | 2/1983 | Molins et al. | 198/347 |
| 5,492,329 | 2/1996 | Kronin | 33/334 |
| 5,697,162 | 12/1997 | Bornand et al. | 33/334 |
| 5,721,713 | 2/1998 | Bornand | 368/10 |

FOREIGN PATENT DOCUMENTS

| | | |
|---|---|---|
| 0 712 059 A1 | 5/1996 | European Pat. Off. . |
| 0 741 344 A1 | 11/1996 | European Pat. Off. . |
| 0 743 576 A1 | 11/1996 | European Pat. Off. . |
| 324 565 | 9/1957 | Switzerland . |
| 346 826 | 5/1960 | Switzerland . |

OTHER PUBLICATIONS

Database WPI, Week 8641,Derwent Publications Ltd., London, GB; AN 86–271119 XP002046981 & SU 1 219 080 A (Leko–R) Lengd Kontakt Assoc.) 23 Mar. 1986.

Patent Abstracts of Japan, vol. 10 No. 15(P–422), 21 Jan. 1986 & JP 60 171413A (Kazuo Uema), 4 Sep. 1985.

Patent Abstracts of Japan, vol. 16 No. 319(P–1385), 13 Jul. 1992 & JP 04093609A (Masaki Nakasuga) 26 Mar. 1992.

*Primary Examiner*—Bernard Roskoski

*Attorney, Agent, or Firm*—Griffin, Butler, Whisenhunt & Szipl, LLP

[57] ABSTRACT

The timepiece (42) includes within the case (44) an electronic compass and a sighting device formed of two sighting marks (14, 15) arranged in the upper portion of the case (44) diametrically opposite each other and defining a reference axis of the case (44). The optical means formed by three light emitting diodes (54, 55, 56) are arranged on the surface of the case (44) in a peripheral region situated at six o'clock for warning or informing a user performing a sighting that the reference axis of the sighting device is aligned with a given azimuthal direction. In another embodiment, instead of the optical means, acoustic means or a buzzer are provided, capable of providing a vibration which is audible or perceptible by a user's body.

10 Claims, 4 Drawing Sheets

TIMEPIECE ASSOCIATED WITH A COMPASS AND A SIGHTING DEVICE

The present invention concerns a timepiece associated with a compass and a sight vane or sighting device. The compass allows the direction of magnetic north or any course related to such direction to be determined. The sighting device allows a user to determine accurately a selected azimuthal direction or a given course.

Several types of sighting devices are known, especially within the armaments field and in particular for firearms. Several devices used to determine the course or azimuthal direction of an object or a given region are fitted with sighting devices. Likewise, devices used to indicate the direction corresponding to a given geographical or magnetic azimuth are fitted with sighting devices, in particular for orientation races.

The term sighting device is used to mean a device defining a reference axis which may be arranged in relation to a user's eye so that the latter can visually determine an object or a geographical zone situated in prolongation of said reference axis by orienting the sighting device so that said reference axis intersects the region of said user's eye. Thus an elongated groove of a certain length can act as sighting device. In order to assure accurate and comfortable sighting, a sighting device is generally formed of at least two sighting marks arranged so as to be able to be aligned one behind the other relative to a user's eye and to allow said user's eye to determine via the sighting a geographical zone or an object situated at a distance in prolongation of the alignment of these two sighting marks defining a reference axis.

In conventional orientation devices including a sighting device and a compass with a magnetised hand, the sighting device is formed by two grooves or notches separated from each other during sighting by an empty intermediate region thus allowing a user to align these two grooves or notches one behind the other so that the transverse profile of each of the two grooves or notches appear, to the user's eye, to merge, the user can then accurately determine an object or a geographical zone appearing in prolongation of transverse section of said two grooves which appear to him to have merged.

Swiss Patent No. 346 826 discloses a wristwatch associated with a compass and a sighting device. More particularly, this Patent Document discloses a device formed of two modules connected to each other by a hinge, the lower module, with which the means for fixing a wristlet are associated, including a compass formed by a magnetised hand, and the upper module forming a case including a clockwork movement associated with time display means protected by a crystal. A sighting system including two sighting marks formed respectively by two diametrically opposite notches arranged along the 6 o'clock–12 o'clock axis of the watch, i.e. along the longitudinal direction of the wristlet, are provided in the lower module including the magnetised hand. In order to allow a user to perform a sighting, the upper module including the clockwork movement has a mirrored bottom. By means of the hinge, the upper module may be brought into a position offset angularly by approximately 45° in relation to the general plane of the lower module, which is parallel to the reference axis defined by the two sighting marks. As a result of this arrangement, a user can perform a sighting. However, such sighting is performed visually through the hinge which defines a free space for this purpose between the two modules when the upper module is angularly offset in relation to the lower module.

The device described hereinbefore has several drawbacks. First, its structure is complex and expensive. Next, the superposition of two independent modules including respectively the clockwork movement and the compass is bulky. Moreover, it is uncomfortable to perform a sighting through the free space provided between the two modules offset angularly be approximately 45°, as is particularly clear from FIG. 1 of this document. This free space is limited and disturbs the user's visual field, which prevents, in particular, ocular accommodation for determining the targeted object or the geographic zone. The fact that the hinge of the two modules is formed by four arms arranged in pairs at the two ends of a small bar or a shaft does not allow the problem of significant reduction in the user's visual field and the user's ocular accommodation to be resolved given that it is the upper module which poses a major problem. Thus, even if the clockwork movement was placed in the lower module and only an upper cover was provided whose inner surface defines a mirror, the drawbacks resulting from the teaching of Swiss Patent Document 346 826 remain in their entirety.

Swiss Patent Document No. 324 565 discloses a wristwatch with a case mounted so as to pivot to allow such case to be rotated so as to allow either the time display or the magnetised hand of a compass to appear in the visible upper part of the watch. For this purpose, the case is mounted on a frame including means for attaching a wristlet thereto. Two sighting marks are fixed onto this frame, also formed by two notches whose walls are situated just above the surface defined by the glass protecting the magnetised hand of the compass. This watch-compass includes a sighting device and it does not include any modules or hinged mirror arranged above the compass module and the sighting device, but the sighting device disclosed in Swiss Patent Document No. 324 565 is not functional since it does not really allow a sighting to be performed in the manner defined hereinbefore. Indeed, when the user arranges the two sighting marks so that the two notches appear, to his eye, to merge, i.e. the transverse profiles of these two notches are superposed and thus appear merged to his eye, the magnetised hand of the compass is no longer visible and thus any accurate sighting is impossible.

Those skilled in the art encounter a major problem in relation to the teaching of the prior art regarding timepieces associated with a sighting device which the present inventors have brought to light, namely that one of the devices is absolutely non-functional, whereas the other device is complex, expensive and uncomfortable to use, which makes such device hardly functional and of dubious use.

Having thus brought to light the problem raised by the timepieces of the prior art, in particular wristwatches, associated with a compass and a sighting device, the present inventors propose to provide a solution to this problem which overcomes the aforementioned major drawbacks by providing a timepiece associated with a compass and a sighting device which is of relatively uncomplicated structure and in particular compact, while being perfectly functional for performing a sighting in a comfortable, sure and efficient manner.

The present invention thus concerns a timepiece including a case and time display means, said timepiece being associated with a compass and a sighting device together allowing determination of a selected azimuthal direction, characterised in that said compass is an electronic compass and in that an electronic unit is provided, electrically connected to said compass and arranged for determining, via signals provided by said compass, the azimuthal orientation of a reference axis of said timepiece, and alarm means are provided controlled by said electronic unit for providing at least one signal perceptible to a user of said timepiece when he performs a sighting by means of the sighting device, said electronic unit being arranged so that said signal is provided to said user when said reference axis is aligned with said selected azimuthal direction.

As a result of the features of the invention, it is possible to perform a sighting comfortably via the sighting device provided without having to use a mirror. Thus, there is no need to provide a device having two hinged modules or, more simply, having a hinged upper cover with a mirrored bottom as is the case in the aforecited prior art. The device according to the invention preferably includes a sighting device formed of two sighting marks arranged in the upper portion of the timepiece case, in particular in the region of the bezel or the crystal forming said case. In order to allow comfortable sighting when the timepiece forms a wristwatch worn on the user's wrist, the reference axis defined by the sighting device, in particular by two sighting marks forming such a sighting device, corresponds to the 6 o'clock–12 o'clock axis of the case.

According to a first main embodiment of the invention, the alarm means are formed by electrically activated acoustic means, said perceptible signal forming an acoustic signal.

According to a second main embodiment of the invention, the alarm means are formed by electrically activated optical means, providing a visual signal able to be perceived by the user during sighting. According to a preferred embodiment, the optical means are arranged at the surface of the case in the region thereof situated substantially at 6 o'clock.

Other particular features and other advantages of the present invention will be described in more detail hereinafter with the aid of the following description, made with reference to the annexed drawings, given by way of non-limiting examples, in which.

Figure 1:
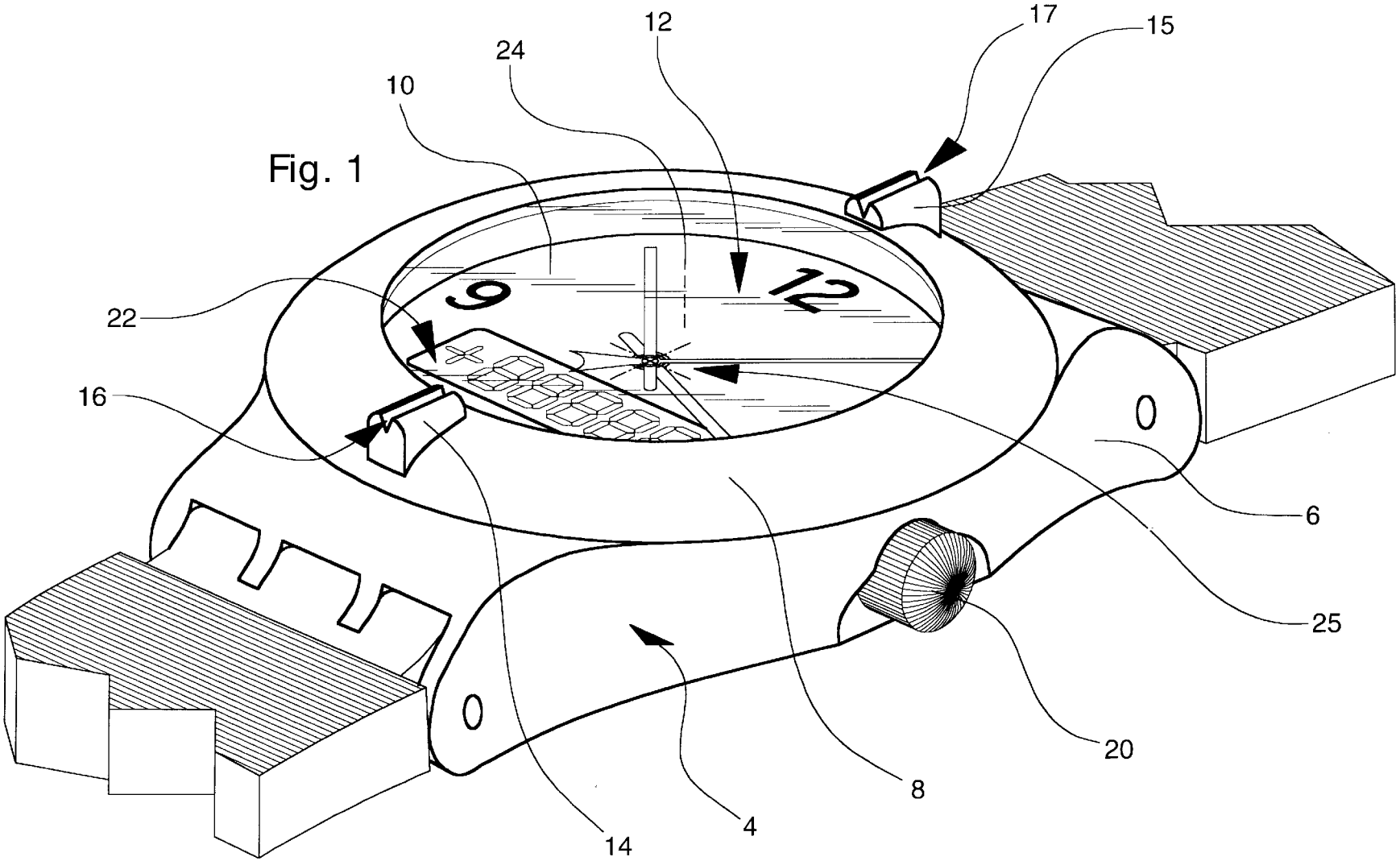
FIG. 1 is a perspective view of a first embodiment of a timepiece according to the invention.
Figure 2:
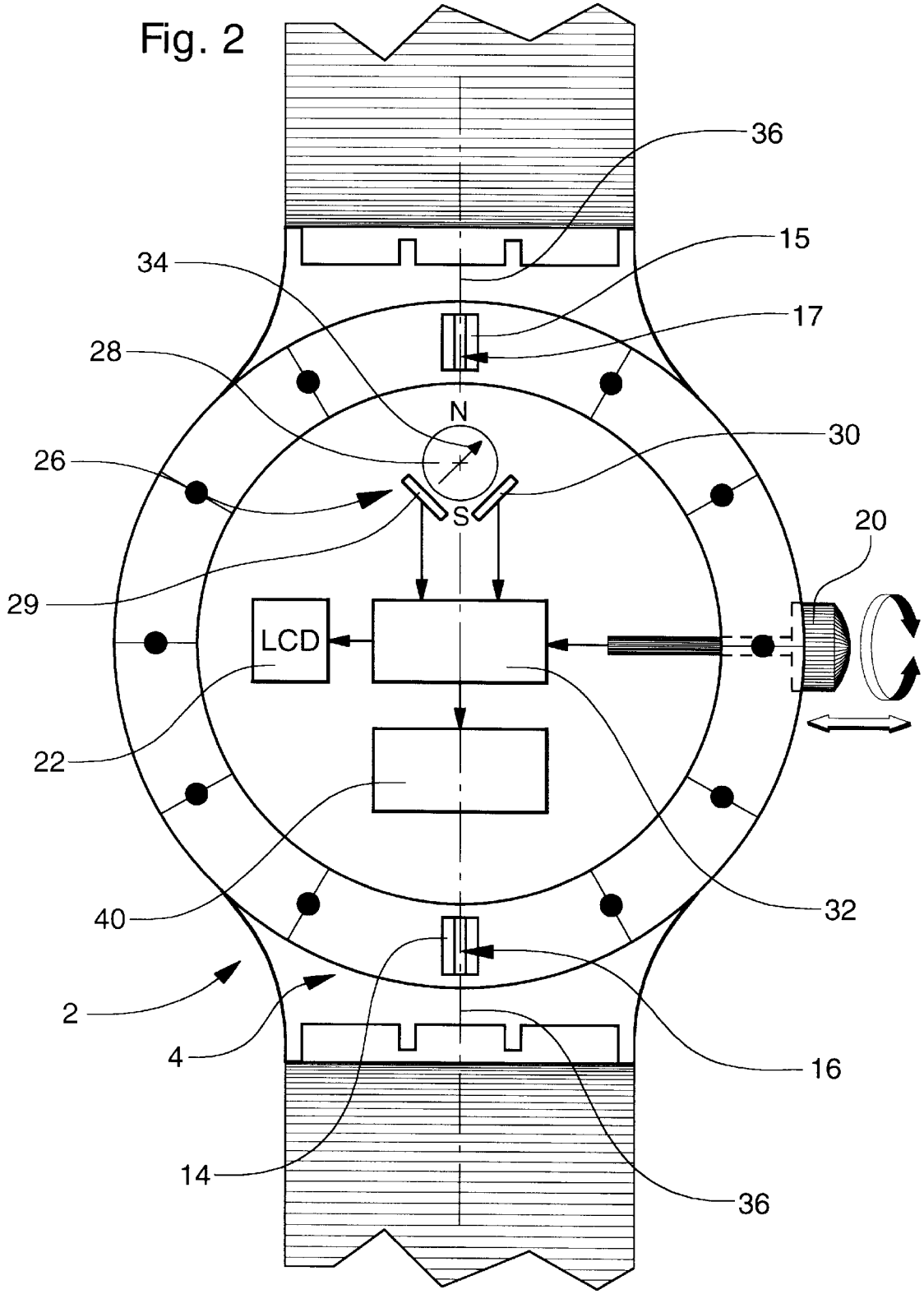
FIG. 2 is a schematic view of the first embodiment showing the timepiece associated with a sighting device and a compass.

With reference to FIGS. 1 and 2, a first embodiment of the invention will be described hereinafter. The wristwatch 2 includes a case 4 formed of a middle part 6, a bezel 8 and a crystal 10 covering and protecting display means 12.

Two sighting marks 14 and 15 forming a sighting device are arranged on bezel 8. The two grooves or notches 16 and 17 are aligned with each other and together define a reference axis whose direction corresponds to the 6 o'clock–12 o'clock axis of watch 2. Watch 2 further includes a crown 20 and an LCD display 22. Moreover, display means 12 include a dial 24 and a set of hands 25 allowing analogue indication of the time or other variables, in particular one of the hands of set of hands 25 may be used to indicate a direction.

Within case 4 is arranged an electronic compass 26 including a permanent magnet 28 mounted so as to rotate freely within case 4 and two electromagnetic sensors 29 and 30 known to those skilled in the art and offset angularly by 90° in relation to the axis of rotation of permanent magnet 28. The two electromagnetic sensors 29 and 30 each supply an electric signal to an electronic unit 32 arranged for processing the electric signals received from electromagnetic sensors 29 and 30 so as to determine accurately the direction of the magnetic axis 34 of permanent magnet 28 in the general plane of case 4. Since electromagnetic sensors 29 and 30 are attached to case 4, electronic unit 32 can determine, via processing known to those skilled in the art, the azimuthal orientation of the reference axis 36 defined by the two sighting marks 14 and 15. For determining the azimuthal orientation of case 4 and for performing a sighting via sighting device 14, 15, the general plane of case 4 is preferably horizontal.

According to the invention, an acoustic alarm 40 is provided, electrically connected to electronic unit 32. Those skilled in the art know how to arrange in a watch a buzzer or acoustic device able to provide sounds or acoustic signals perceptible to a user of watch 2. Those skilled in the art will find descriptions of buzzer or acoustic device arrangements in particular in European Pat. Nos. 0 741 344 and 0 712 059 and U.S. Pat. Nos. 4,267,849, 4,330,878 and 4,373,624, such Patent Documents being incorporated by reference in the present description.

Electronic unit 32 is arranged to control the alarm means, formed by acoustic device 40, to provide at least a first acoustic signal perceptible to a user of watch 2 when he performs a sighting via sighting device 14, 15. More particularly, electronic unit 32 controls acoustic device 40 so that the user is informed by any acoustic signal when reference axis 36 is aligned with a selected azimuthal direction. In order to activate the compass mode and thus allow a user to perform a sighting, the crown or control stem 20 which is electrically connected to electronic unit 32 is used. Then, to select an azimuthal direction, a course or given azimuth is input into a memory portion of electronic unit 32 by means of the crown or electronic stem 20 in association with LCD display 22. Once watch 2 is set in compass mode, the LCD display indicates an angular deviation in relation to the direction of magnetic north or geographical north according to the given embodiment and in particular the possibility of inputting either the geographical position of the user, or inputting the magnetic deviation value of geographic north relative to magnetic north.

Those skilled in the art know how to arrange electronic unit 32 to allow inputting of either magnetic deviation and geographic values or magnetic azimuth values according to the mode of use foreseen. As a result of the arrangement described hereinbefore, a user may thus select an azimuthal direction, then perform a sighting precisely in this selected azimuthal direction via sighting device 14, 15, while keeping wristwatch 2 on his wrist.

During the sighting, the user does not see display means 12 but is informed by acoustic device 40 when case 4 of watch 2 is oriented towards the selected azimuthal direction, namely when the 6 o'clock–12 o'clock axis corresponding to reference axis 36 is aligned with this selected azimuthal direction. As the space above sighting device 14, 15 is completely free, a user can thus perform a sighting efficiently, comfortably and accurately to reach the target or to determine the magnetic or geographic azimuth of an object or a geographic zone in relation to the geographic position in which he is situated.

It will be noted that to activate watch 2 in compass operating mode and to input data necessary to select a given direction, any inputting means known to those skilled in the art may be used, in particular inputting using a rotating bezel, capacitive sensors or pressure, buttons, push-buttons or even set of hands 24.

Acoustic device 40 may have several functions and be used in various ways to provide the signal necessary for the user who performs a sighting using wristwatch 2. In order to give an indication to the user of the deviation of case 4 relative to the selected azimuthal direction, it is possible to provide various sounds or a sound having a variable frequency and/or variable amplitude. Thus, for example, electronic unit 32 is arranged for controlling the acoustic device so that it provides a signal having a first frequency, in compass operating mode, when reference axis 36 does not coincide with the selected azimuthal direction, this signal having an increasing or decreasing amplitude according to whether the angular shift between the selected direction and reference axis 36 increases or decreases. When reference axis 36 is aligned with the selected direction, the acoustic device is controlled so as to provide another signal having a different frequency to the non-alignment signal described hereinbefore. It is also possible to mark such a difference by varying the tonality of the sounds provided. Those skilled in the art may provide various alternatives for the operation and control of the alarm means while remaining within the scope of the present invention.

Figure 3:
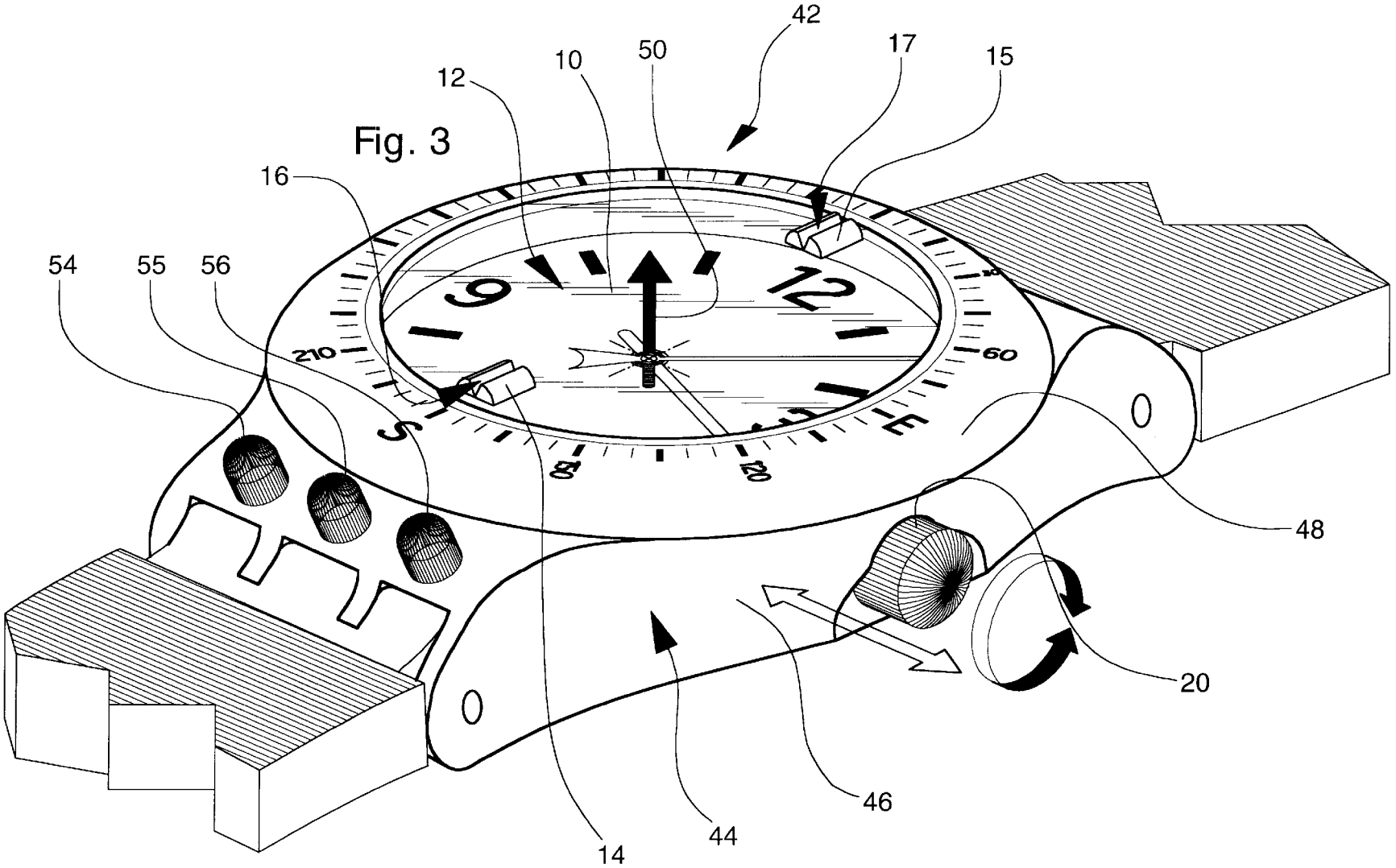
FIG. 3 is a perspective view of a second embodiment of a timepiece according to the invention.
Figure 4:
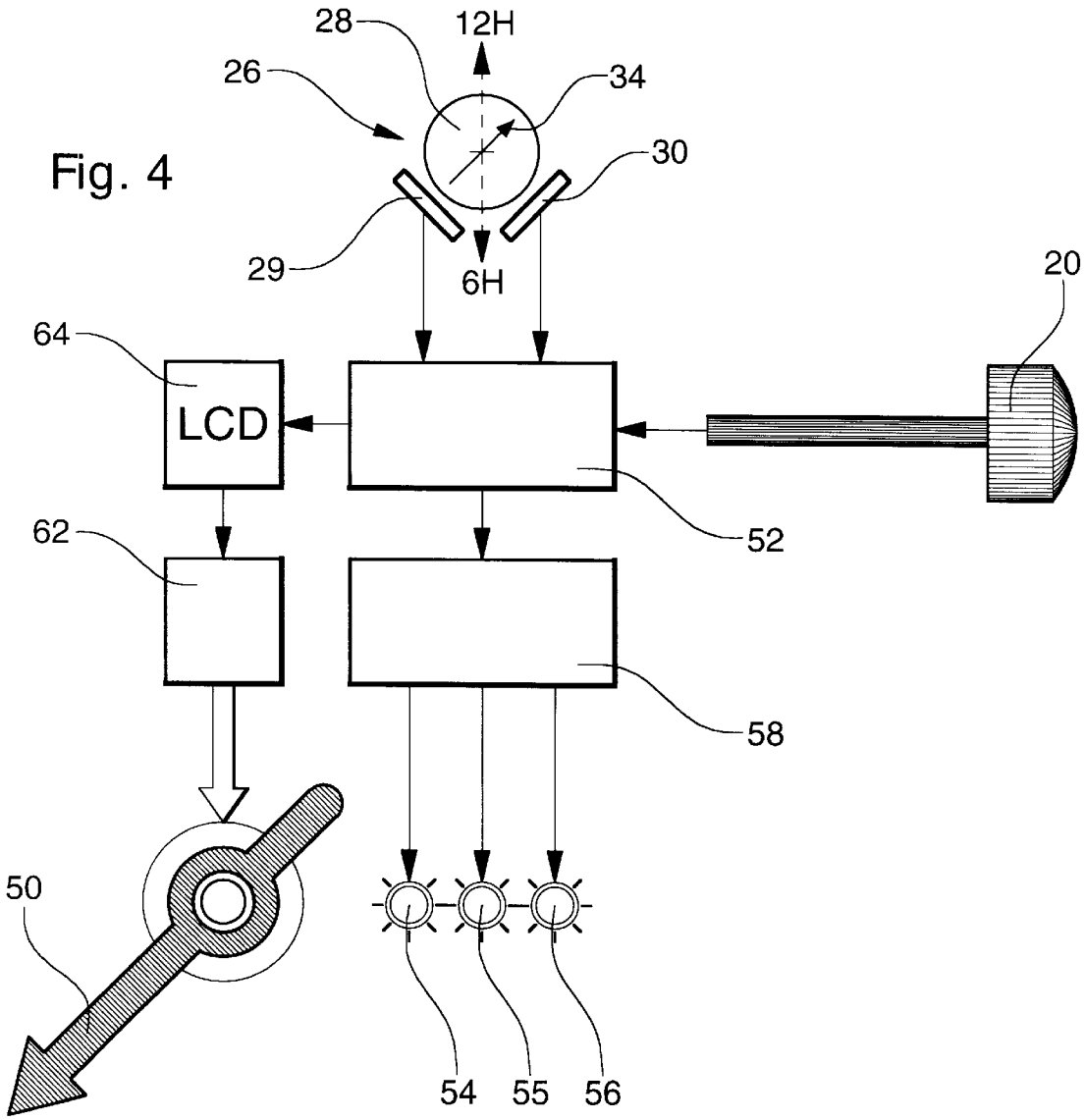
FIG. 4 shows schematically the arrangement of the second embodiment and the operation thereof.

With reference to FIGS. 3 and 4, a second embodiment of the invention will be described hereinafter. The references already described in the description of the first embodiment will not all be described again here in detail.

Wristwatch 42 includes a case 44 formed of a middle part 46, a bezel 48 and a crystal 10 covering and protecting time display means 12. Two sighting marks 14 and 15 having respectively two aligned grooves or notches 16 and 17 together defining a reference axis of case 44 parallel to the 6 o'clock–12 o'clock axis of said case are arranged on crystal 10. Within case 44 is also arranged an electronic compass 26 whose two electromagnetic sensors 29 and 30 each supply an electric signal to an electronic unit 52 which, like electronic unit 32 of the first embodiment described hereinbefore, allows the position of the case to be determined in relation to the direction of magnetic north or geographic north according to the referential selected. Electronic unit 52 is thus arranged for determining the azmimuthal direction of case 44, in particular the azimuthal direction defined by the reference axis defined by sighting device 15, 16.

In this second embodiment, the hour hand 50 is used, when watch 42 is activated in a compass mode in particular using crown 20, to indicate the direction of magnetic or geographic north or the direction of a given course or azimuth. Given that sighting marks 14 and 15 are arranged on crystal 10, it is easy in this embodiment, to provide a bezel 48 which rotates and can thus be used to determine a given azimuthal direction without performing any sighting when the direction to be followed does not need to be known precisely by the user of watch 42.

In this second embodiment, the alarm means, which are used to indicate to the user performing a sighting when the reference axis defined by sighting device 14, 15 is aligned with a selected azimuthal direction, are formed by electrically activated optical means. In the example given for this second embodiment, these optical means are formed by three light emitting diodes 54, 55, 56 arranged on the surface of case 44, more particularly on an external upper surface of middle part 46 in a region situated at 6 o'clock. Thus, when a user performs a sighting and the plane defined by crystal 10 is situated substantially at the level of his eyes, said user can see diodes 54, 55, 56 without any problem and perceive one or more optical signals provided by said diodes.

Electronic unit 52 is electrically connected to a power supply for diodes 54, 55 and 56. Diodes 54, 55 and 56 can be used in various ways according to various alternatives to warn or inform a user of the fact that the reference axis defined by sighting device 14, 15 is aligned or not aligned with a selected azimuthal direction. For example, when the user has to rotate case 44 in an anti-clockwise direction, diode 54 is activated and provides a light signal. Conversely, when case 44 has to be rotated in the clockwise direction, it is diode 56 which provides a light signal. Once the reference axis is aligned with the selected azimuthal direction, central diode 55 is activated and provides a light signal, or it is possible for all three diodes 54, 55 and 56 to be activated. In another alternative, it is even possible for the signal provided by the diodes to consist of an absence of light transmission, when the reference axis is properly aligned with the selected direction. The diodes may be different colours, for example, external diodes 54 and 56 may be red while central diode 55 is green.

It will be noted that when a user performs a sighting, direction indicating hand 50 is not visible to the user, hence the full use and efficiency of the alarm means arranged on middle part 46. The second embodiment with the visual alarm means allows watch 42 to be used as a compass and underwater/sub-marine orientation device, i.e. it is able to be used for diving.

Finally, it will be mentioned that indicating hand 50, used alternately to indicate the time or a given direction, is driven by a motor 62 supplied by an electric power supply 64 electrically connected to electronic unit 52 which is arranged for controlling said motor 62.

It will be noted that those skilled in the art can provide other alarm means supplying at least one signal perceptible by a user of a timepiece according to the invention when such user performs a sighting by means of the sighting device associated with said timepiece. As third embodiment, a similar timepiece to watch 2 of the first embodiment will be mentioned, wherein acoustic device 40 is replaced by a low frequency buzzer providing a vibration perceptible by the user's body. The other elements of the invention as described in the first embodiment remain the same.

What is claimed is:

1. A timepiece including a case and display means used in particular for displaying the time, said timepiece being associated with a compass and a sighting device together allowing determination of a selected azimuthal direction, wherein said compass is an electronic compass and wherein an electronic unit is provided, electrically connected to said compass and arranged for determining, via signals provided by said compass, the azimuthal orientation of a reference axis of said timepiece, and alarm means are provided controlled by said electronic unit for providing at least one signal perceptible to a user of said timepiece when he performs a sighting by means of said sighting device, said electronic unit being arranged so that said signal is provided to said user when said reference axis is aligned with said selected azimuthal direction.

2. A timepiece according to claim 1, wherein said alarm means are formed by an electrically activated acoustic device.

3. A timepiece according to claim 1, wherein said alarm means are formed by optical means which are electrically activated by an electric power supply connected to said electronic unit.

4. A timepiece according to claim 3, wherein said optical means are formed by at least one diode arranged on an external surface of the case in a region of said case situated substantially at 6 o'clock relative to a conventional 12 hour time display.

5. A timepiece according to claim 1, wherein said alarm means are formed by a buzzer providing a vibration signal perceptible by a user's body.

6. A timepiece according to claim 1, wherein said sighting device is formed by two sighting marks arranged on a bezel of said case diametrically opposite each other and along the 6 o'clock–12 o'clock axis of said timepiece.

7. A timepiece according to claim 1, wherein said sighting device is formed by two sighting marks arranged on said crystal diametrically opposite each other and along the 6 o'clock–12 o'clock axis of said timepiece.

8. A timepiece according to claim 7, wherein said bezel is a rotating bezel.

9. A timepiece according to claim 1, wherein an indicating hand is provided, used to indicate a given azimuthal direction, in particular the direction of magnetic or geographic north.

10. A timepiece according to claim 1, wherein it includes an electronic crown and digital display means arranged for allowing a user to input any azimuthal direction.

* * * * *